US008721388B2

(12) United States Patent
Quaranta

(10) Patent No.: US 8,721,388 B2
(45) Date of Patent: May 13, 2014

(54) SELF-ADJUSTING SHAPEWEAR GARMENT

(75) Inventor: Kristen Quaranta, Chappaqua, NY (US)

(73) Assignee: Maidenform LLC, Winston-Salem, NC (US)

( * ) Notice: Subject to any disclaimer, the term of this patent is extended or adjusted under 35 U.S.C. 154(b) by 202 days.

(21) Appl. No.: 13/325,769

(22) Filed: Dec. 14, 2011

(65) Prior Publication Data

US 2012/0144548 A1 Jun. 14, 2012

Related U.S. Application Data

(60) Provisional application No. 61/422,790, filed on Dec. 14, 2010.

(51) Int. Cl.
*A41C 3/00* (2006.01)
*A41C 1/02* (2006.01)
*A41C 1/04* (2006.01)

(52) U.S. Cl.
CPC .... *A41C 1/02* (2013.01); *A41C 1/04* (2013.01)
USPC ..... 450/69; 450/73

(58) Field of Classification Search
USPC ..... 2/69, 73, 113, 228, 406; 450/94, 1
See application file for complete search history.

(56) References Cited

U.S. PATENT DOCUMENTS

| | | | | |
|---|---|---|---|---|
| 3,678,514 | A * | 7/1972 | Safrit | 2/212 |
| 3,788,366 | A | 1/1974 | Campbell, Sr. et al. | |
| 5,052,058 | A * | 10/1991 | Mueller | 2/228 |
| 5,553,468 | A * | 9/1996 | Osborne | 66/171 |
| 5,746,068 | A * | 5/1998 | Popa et al. | 66/176 |
| 5,836,179 | A * | 11/1998 | van Laar | 66/171 |
| 6,125,664 | A * | 10/2000 | Browder, Jr. | 66/176 |
| 6,223,782 | B1 | 5/2001 | Watkins | |
| 6,704,942 | B2 * | 3/2004 | Lazarian | 2/409 |
| 7,024,892 | B2 * | 4/2006 | Blakely | 66/177 |
| 2004/0000173 | A1 | 1/2004 | Keller | |
| 2008/0034476 | A1 | 2/2008 | MacKinnon | |

* cited by examiner

*Primary Examiner* — Gloria Hale
(74) *Attorney, Agent, or Firm* — Dickstein Shapiro LLP

(57) ABSTRACT

The present invention relates generally to a garment made from a stretchable fabric with a high yield strain and low hysteresis so that the garment is capable of stretching to comfortably fit and provide support for the unique shapes and curves of wearers within a single size group and across multiple size groups. More specifically, the claimed invention relates to shapewear. A shapewear garment constructed in accordance with the present invention could be made in a first standard size and comfortably flex and self-adjust to fit wearers across sizes extra-small (XS), small (S), and medium (M); and in a second standard size and comfortable flex and self-adjust to fit wearers across sizes large (L), extra-large (XL), and double extra-large (XXL); and the garment would retain its original dimensions when the force exerted on the garment by the wearer's body is removed.

10 Claims, 4 Drawing Sheets

SELF-ADJUSTING SHAPEWEAR GARMENT

CROSS REFERENCE TO RELATED APPLICATIONS

The present application claims priority to provisional application No. 61/422,790, filed Dec. 14, 2010, the entire contents of which are incorporated by reference herein by reference in their entirety.

FIELD OF THE INVENTION

The present invention relates generally to a garment formed to provide increased comfort, support, and/or flexibility to the wearer. In particular, the present invention relates to a shapewear garment that provides a stretchable and/or customized fit to accommodate differently shaped and/or sized body portion(s) across different shape and/or size groups to enhance comfort, support, and/or flexibility to many different wearers.

BACKGROUND OF THE INVENTION

Many women have parts of their bodies that they are unhappy with, making them have an insecure feeling when wearing certain clothing. Foundation garments have been worn for a very long time to address this problem. Better known today as shapewear, these foundation garments include body briefs, bodysuits, brassieres, control top panty hose, control panties, control briefs, control slips, control camisoles, control tanks, hip slips, waist shapers, corsets, garter belts, and girdles.

Shapewear are undergarments designed to change the wearer's shape, producing a more fashionable, slim figure and to enhance the natural curves of the body. Take for example control briefs. They are designed to lift a wearer's bottom, flatten the tummy and add shape and form to the thighs.

Garments, including shapewear, are typically made in standard sizes (e.g., small (S), medium (M), large (L), extra-large (XL), etc. or 0, 2, 4, 6, 8, etc.), each of which is intended to fit a group of wearers having similar body shapes and sizes. Within any size group, the intended wearers may nevertheless have somewhat different heights, weights, bone structure, and/or muscle tone. As a result, a garment constructed in accordance with a standard size system cannot comfortably fit all wearers in the same size group. This is particularly true when the garments are designed to fit closely on the wearers' bodies.

Custom tailoring is a conventional technique used to fit a garment to a specific wearer by first measuring the wearer, and then making, or modifying, the garment according to the measurement. Although custom tailoring can be employed to address the above-mentioned problem, the cost and effort associated with custom tailoring makes it impractical to supply to the mass market.

SUMMARY OF THE INVENTION

The present invention relates generally to a garment that is made from one or more stretchable fabrics having properties that allow the garment to stretch to comfortably conform to a wearer's unique shapes and curves not only within a size group, but across multiple size groups. The garment is preferably made from at least one stretchable fabric containing a fiber that has a high yield strain and a low hysteresis, thereby providing a fabric with optimum stretching with less force and greater recovery power. This results in a wearer experiencing little or no perceptible resistance to stretch movements, as well as a quick shape recovery so as to closely conform to the body of the wearer.

The one or more stretchable fabrics that the main body of the garment is made from contain a fiber having a high yield strain such that the fiber is capable of undergoing significant elongation without plastically deforming. A garment constructed from such a stretchable fabric will be able to stretch to fit wearers whose body dimensions fall into multiple size groups and recover its original dimensions when the wearer takes off the garment (i.e., the fibers of the stretchable fabric do not plastically deform based on the stretching forces put on the garment by the wearer's body). This results in a garment that can be formed according to a standard size system, yet capable of stretching to fit to the unique shapes and curves not only of wearers within a size group, but across multiple size groups.

For example, a garment constructed in accordance with the present invention could comfortably fit and conform to the body of a wearer whose body dimensions fall within the ranges associated with the small (S) size group. The size small (S) wearer could then lend the garment to a friend whose body dimensions fall within the ranges associated with the large (L) size group. The garment would be capable of stretching to comfortably fit and conform to the body of the friend. When the friend takes the garment off, thereby removing applied forces on the garment, the garment would substantially recover its original dimensions. The garment could then be re-worn by the size small (S) original wearer and provide the same comfort and conformity that it had originally provided before it was worn by the size large (L) friend. For example, four hours after a 10 lb. load had been removed, a stretchable fabric made from a fiber as described herein returned to within 1% of its original length in the warp direction and within 2% of its original width in the weft direction.

In an embodiment of the present invention, the garment is configured as shapewear that self-adjusts to a variety of different shape and size wearers, while also providing the ability to continuously self-adjust to that particular wearer when that wearer's body changes shape and/or size such as when the wearer bends her body during various physical activities or changes occurring during natural physiological cycles, while enhancing comfort, support, and/or flexibility to the wearer. A shapewear garment of the present invention can be configured as any type of shapewear described herein (i.e., body briefs, bodysuits, brassieres, control top panty hose, control panties, control briefs, control slips, control camisoles, control tanks, hip slips, waist shapers, corsets, garter belts, and girdles) or within the knowledge of one skilled in the art.

A garment made from the stretchable fabrics described herein may be constructed using known stitching techniques that further enable stretching and recovery. While the types of stitching that serve this purpose are well known in the art, non-exclusive examples of stitches that may be used are hosiery stitches and open overlock stitches.

Optional components may be added to the garment of the present invention in order to further achieve comfort, control, and aesthetic appearance.

BRIEF DESCRIPTION OF THE DRAWINGS

For the purposes of illustrating the present invention, there is shown in the drawings an illustrative form, it being understood however, that the invention is not limited to the precise form shown by the drawings in which.

DETAILED DESCRIPTION OF THE INVENTION

Figure 1:
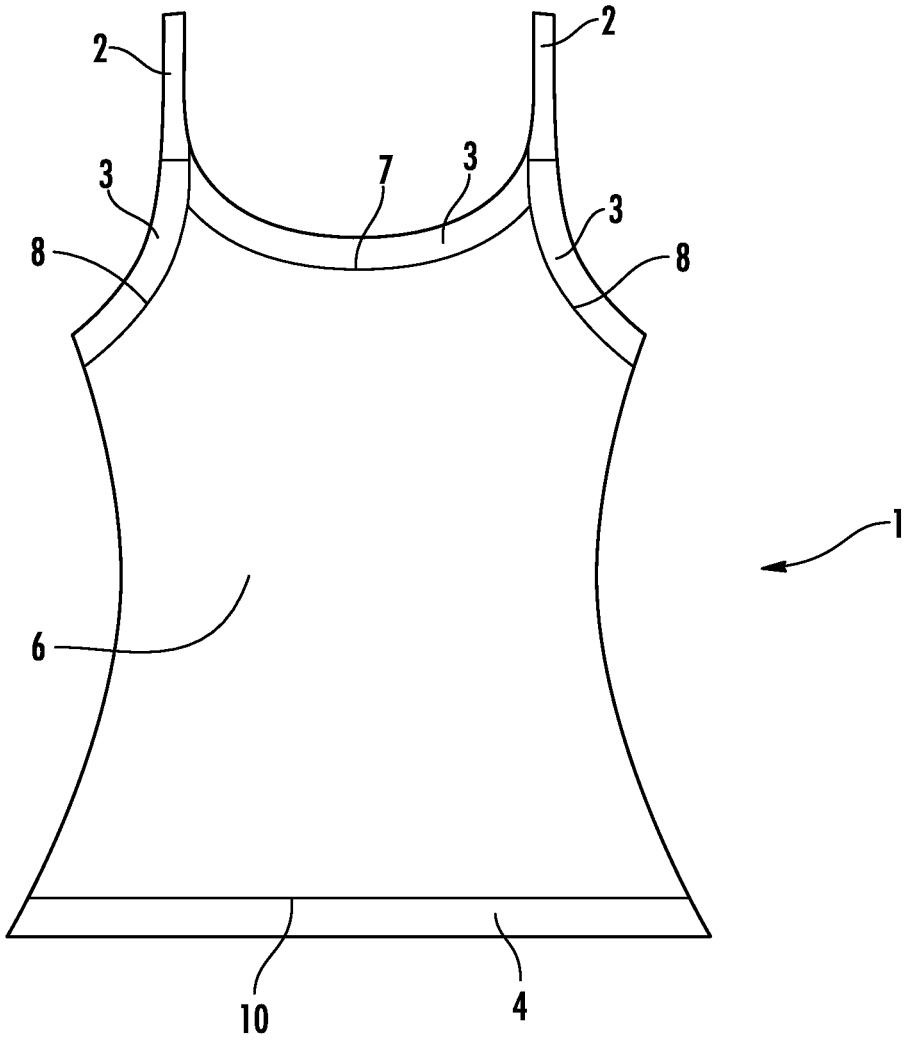
FIG. 1 is a front view of shapewear configured as a tank top according to an embodiment of the present invention.

For purposes of this invention, the following terms are defined below.

The term "size group," as used herein, refers to a single garment size as defined by standardized sizing systems or catalog sizes, and usually denoted on a tag or label affixed to garments that are sold off-the-shelf. In the United States, garment sizes are typically denoted numerically (e.g., 0, 2, 4, 6, 8, etc.) or alphabetically (e.g., extra-small (XS), small (S), medium (M), large (L), extra-large (XL), double extra-large (XXL), etc.). By way of example, size 2 is a "size group," or size large (L) is a "size group."

The term "multiple size groups," as used herein, refers to a combination of one or more size groups. A "multiple size group" may consist of two consecutive size groups (e.g., small (S) through medium (M)) or more than two consecutive size groups (e.g., large (L) through double extra-large (XXL)).

The present invention will next be illustrated with references to the figures. In the various embodiments illustrated, the shapewear garment of the present invention is configured as a tank top 1 (FIGS. 1-2), a thigh slimmer 11 (FIG. 3), and a singlet 14 (FIG. 4). However, the present invention is not limited to a tank top, a thigh slimmer, and a singlet, but may also include other types of shapewear described herein (i.e., body briefs, bodysuits, brassieres, boy shorts, panties, briefs, slips, camisoles, hip slips, waist shapers, corsets, garter belts, and girdles) or configurations within the knowledge of one skilled in the art. As such, the exemplary types of shapewear shown in the drawings are not to be considered limiting in any manner.

In the embodiments illustrated in FIGS. 1-4, the shapewear garments generally comprise a main body 6 made of at least one stretchable fabric and may also include various optional components. The stretchable fabrics that form the main body 6 are preferably made from a fiber that has a high yield strain and a low hysteresis, thereby providing a fabric with optimum stretching with less force and greater recovery power. The stretchable fabric(s) can be composed of a nylon/elastane material blend, for example, weighing in the range from about 6.2 to about 6.9 oz/yd$^2$ and comprised of 72% nylon and 28% LYCRA® elastane. The stretchable fabric(s) preferably has an elongation in the range from about 104% to about 187% in the warp direction and in the range from about 87% to about 115% in the weft direction, when put under a 10 lb. load. The stretchable fabric(s) also preferably has a modulus of elasticity in the range from about 1.09 to about 3.31 when the elongation of the material in the warp direction is about 40% and in the range from about 1.72 to about 5.00 when the elongation of the material in the warp direction is about 60%. The stretchable fabric(s) also preferably has a modulus of elasticity in the range from about 0.75 to about 1.5 when the elongation of the material in the weft direction is about 20%. The stretchable fabric(s) may have a stitch count of 53-59 wales per inch and 174-192 courses per inch. Such a stretchable fabric is available from Best Pacific Textile Ltd. as item number 63766MS. Although this material is given as an example, it will be appreciated that other materials known in the art may be used.

In another embodiment of the present invention, the stretchable fabrics may be constructed to have a selvedge made from the same or a different fabric as the main body 6. It will be appreciated that such a construction prevents the edge of the fabric from unraveling or fraying while providing a seamless look when worn under a wearer's form-fitting attire. For example, the selvedge can be around the leg openings 12 of a thigh slimmer 11 or a singlet 14.

The elongations of the stretchable fabrics were measured under the noted load during the third cycle at the outgoing stretch, similar to the various test procedures specified in the ASTM D4964 Standard. As will be understood, the aforementioned specifications regarding approximate elongation and modulus of elasticity are merely examples and are not limiting.

Figure 2:
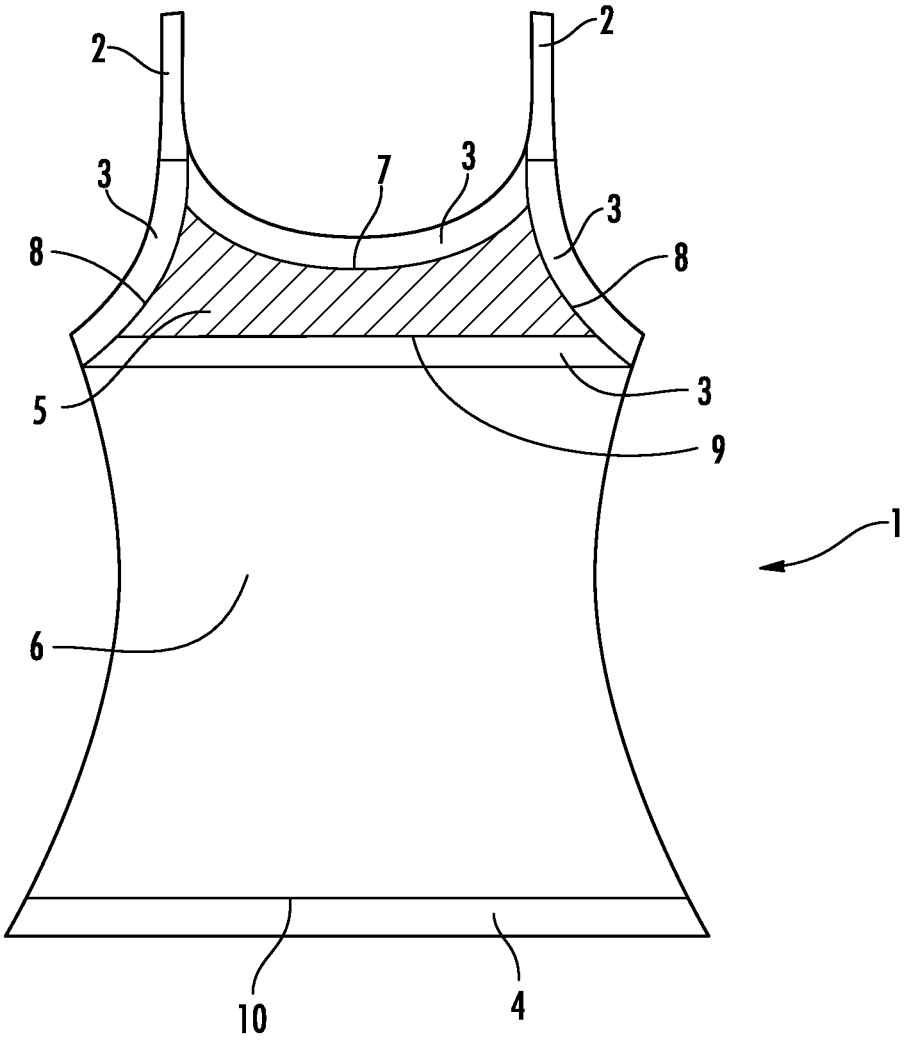
FIG. 2 is a back view of the tank top of FIG. 1.

In the embodiment illustrated in FIGS. 1 and 2, the garment of the present invention is configured as a tank top 1. The tank top 1 has a main body 6 made from at least one stretchable fabric having the elongation and recovery properties described above. The tank top 1 may optionally include an inner layer 5. In addition, one or more shoulder straps 2 can be provided and joined to the main body 6 in various conventional manners. The tank top 1 may include further additional components, for example, a facing elastic 3 formed of known materials and joined in conventional manners to the main body 6 at various areas including the neckline 7, arm holes 8, and top-back 9. In the embodiment shown, the tank top 1 includes a waist elastic 4 formed of known materials and joined in conventional manners to the main body 6 at the waistline 10.

Figure 3:
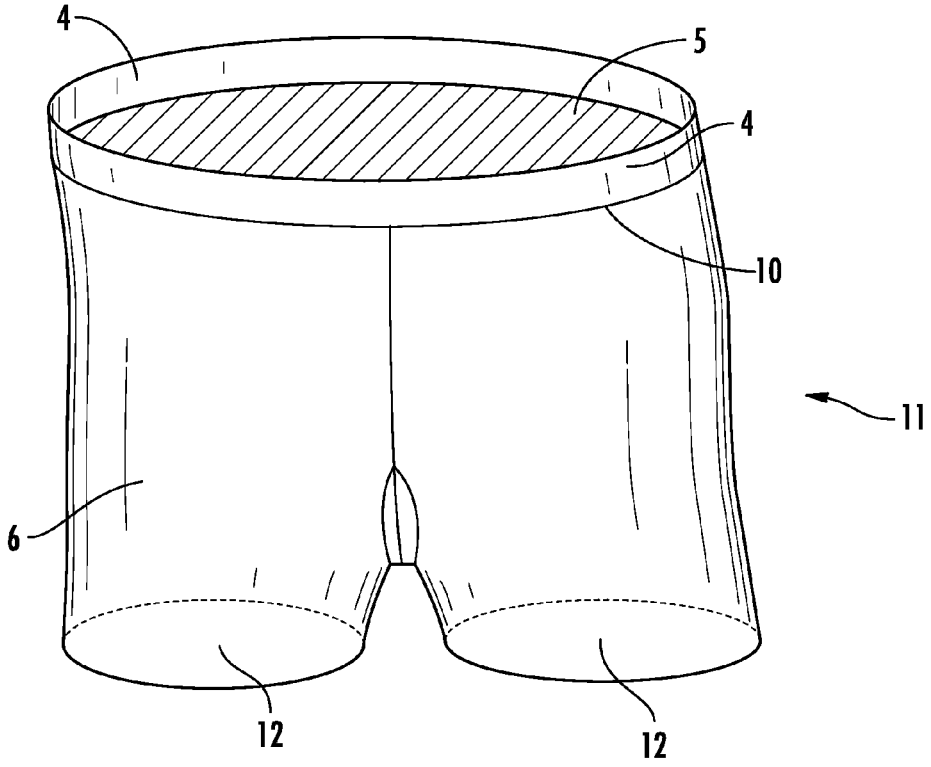
FIG. 3 is an isometric view of shapewear configured as a thigh slimmer according to an embodiment of the present invention.
Figure 4:
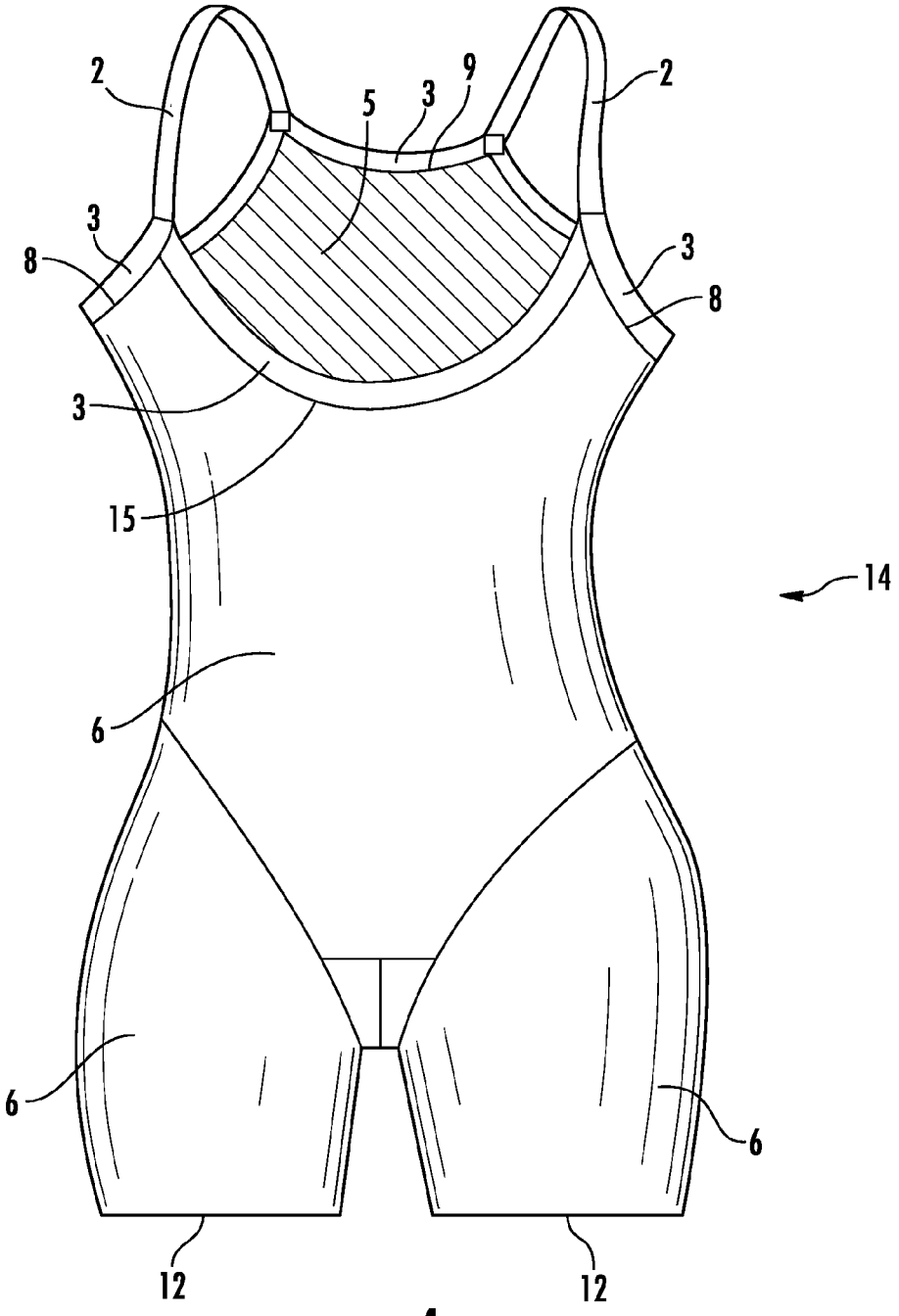
FIG. 4 is the front view of shapewear configured as a singlet according to an embodiment of the present invention.

In the embodiment illustrated in FIG. 3, the garment of the present invention is configured as a thigh slimmer 11. The thigh slimmer 11 has a main body 6 made from at least one stretchable fabric having the elongation and recovery properties described above. In the embodiment shown, the thigh slimmer 11 includes an inner layer 5 and waist elastic 4 formed of known materials and joined in conventional manners to the main body 6 at the waistline 10.

In the embodiment illustrated in FIG. 4, the garment of the present invention is configured as a singlet 14. The singlet 14 has a main body 6 made from at least one stretchable fabric having the elongation and recovery properties described above. The singlet may optionally be constructed to have a plunging neckline 15 so that the wearer may wear her own brassiere in combination with the singlet 14. While the plunging neckline 15 configuration is shown on a singlet 14, it will be appreciated that the plunging neckline 15 may be applied to other garments constructed in accordance with the present invention. The singlet 14 may also include an inner layer 5 and one or more shoulder straps 2, joined to the main body 6 in various conventional manners. The singlet 14 may further include additional components, for example, a facing elastic 3 formed of known materials and joined in conventional manners to the main body 6 at various areas including the plunging neckline 15, arm holes 8, and top-back 9.

As illustrated in FIGS. 2-4 and as described above, the garment of the present invention may include an optional inner layer 5. The inner layer 5 may be made from conventional materials and joined to inside surface of the main body 6 using known techniques. For example, the inner layer 5 may be made from cotton or a cotton blend material, in order to absorb moisture and provide comfort. The inner layer 5 could also be made from a moisture-wicking material to draw sweat off of the wearer's skin during various physical activities.

It will be appreciated that various other optional components including lace, embroidery, mesh, and the like may be added to any garment constructed according to the present invention for a variety of reasons including improving comfort, control, and aesthetic appearance.

There are many unexpected advantages to the garment construction disclosed herein. Namely, constructing a garment from the material described above unexpectedly allows the garment to fit wearers across multiple size groups as well as the various shapes and curves of a wearer within a size group. For example, a shapewear garment can be made in a first standard size and comfortably flex and self-adjust to fit wearers across sizes extra-small (XS), small (S), and medium (M); and in a second standard size and comfortable flex and self-adjust to fit wearers across sizes large (L), extra-large (XL), and double extra-large (XXL), and recover its original dimensions when forces applied on the garment by the wearer are removed. This in turn allows a manufacturer to greatly reduce the number of items in the product line, and thus significantly reduce manufacturing costs.

While the foregoing description and drawings represent an illustrative embodiment of the present invention, it will be understood that various additions, modifications, and substitutions may be made therein without departing from the spirit and scope of the present invention as defined in the accompanying claims. Therefore, the present invention is not limited to only the embodiments specifically described herein. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A garment comprising:

a main body covering at least a portion of a torso of a wearer, the main body being made of at least one stretchable fabric having an elastic region configured such that the garment stretches to fit wearers within a size group and across multiple size groups, wherein the stretchable fabric has a first elongation between about 104% to about 187% in the warp direction under a 10 pound load, the stretchable fabric has a second elongation between about 87% to about 115% in the weft direction under the 10 pound load, and at least four hours after the 10 lb. load has been removed, the stretchable fabric returns to within 1% of an original length in the warp direction and within 2% of an original width in the weft direction.

2. The garment of claim 1, wherein the main body has a wearer-facing surface and an opposing outer-facing surface; and a layer of material affixed to the wearer-facing surface of the main body.

3. The garment of claim 2, wherein the layer of material is comprised of cotton or a cotton blend.

4. The garment of claim 1, wherein the stretchable fabric has a modulus of elasticity between about 1.09 to about 3.31 when the fabric is 40% elongated in the warp direction.

5. The garment of claim 1, wherein the stretchable fabric has a modulus of elasticity between about 1.72 to about 5.00 when the fabric is 60% elongated in the warp direction.

6. The garment of claim 1, wherein the stretchable fabric has a modulus elasticity between about 0.75 and 1.5 when the fabric is 20% elongated in the weft direction.

7. The garment of claim 1, wherein the stretchable fabric has a stitch count of 53 to 59 wales per inch and 174 to 192 courses per inch.

8. The garment of claim 1, wherein the garment is configured as a tank top.

9. The garment of claim 1, wherein the garment is configured as a thigh slimmer.

10. The garment of claim 1, wherein the garment is configured as a singlet.

* * * * *